US011670872B2

(12) United States Patent
Cheng et al.

(10) Patent No.: US 11,670,872 B2
(45) Date of Patent: Jun. 6, 2023

(54) MOVABLE DEVICE AND BLOCK-TYPE MILLIMETER WAVE ARRAY ANTENNA MODULE THEREOF

(71) Applicant: Taiwan Inpaq electronic Co., Ltd., Miaoli County (TW)

(72) Inventors: Ta-Fu Cheng, Miaoli County (TW); Ting-Wei Lin, Tainan (TW); Cheng-Yi Wang, New Taipei (TW)

(73) Assignee: Taiwan Inpaq electronic Co., Ltd., Miaoli County (TW)

( * ) Notice: Subject to any disclaimer, the term of this patent is extended or adjusted under 35 U.S.C. 154(b) by 62 days.

(21) Appl. No.: 17/535,763

(22) Filed: Nov. 26, 2021

(65) Prior Publication Data

US 2023/0031712 A1 Feb. 2, 2023

(30) Foreign Application Priority Data

Jul. 28, 2021 (TW) ..... 110127632

(51) Int. Cl.

| | |
|---|---|
| ***H01Q 1/52*** | (2006.01) |
| ***H01Q 21/06*** | (2006.01) |
| ***H01Q 1/38*** | (2006.01) |
| ***H01Q 21/24*** | (2006.01) |
| ***H01Q 21/08*** | (2006.01) |

(52) U.S. Cl.

CPC ..... *H01Q 21/065* (2013.01); *H01Q 1/38* (2013.01); *H01Q 21/08* (2013.01); *H01Q 21/24* (2013.01)

(58) Field of Classification Search

CPC ..... H01Q 21/065; H01Q 1/38; H01Q 21/08; H01Q 21/24; H01Q 1/27; H01Q 21/061; H01Q 1/525

See application file for complete search history.

(56) References Cited

U.S. PATENT DOCUMENTS

2021/0044020 A1* 2/2021 Liu ..... H01Q 21/062
2021/0367344 A1* 11/2021 Kimura ..... H01Q 19/005

* cited by examiner

*Primary Examiner* — David E Lotter
(74) *Attorney, Agent, or Firm* — Li & Cai Intellectual Property (USA) Office

(57) ABSTRACT

A movable device and a block-type millimeter wave array antenna module thereof are provided. The block-type millimeter wave array antenna module includes an antenna carrying substrate, an antenna signal transmitting group, an antenna signal receiving group, and a dummy antenna group. The antenna carrying substrate includes a plurality of block-shaped carrier bodies that are divided into a plurality of first, second, third, and fourth antenna carrier blocks. The antenna signal transmitting group includes a plurality of signal transmitting antenna structures respectively carried by the first antenna carrier blocks. The antenna signal receiving group includes a plurality of signal receiving antenna structures respectively carried by the second antenna carrier blocks. The dummy antenna group includes a plurality of first dummy antenna structures respectively carried by the third antenna carrier blocks, and a plurality of second dummy antenna structures respectively carried by the fourth antenna carrier blocks.

10 Claims, 11 Drawing Sheets

MOVABLE DEVICE AND BLOCK-TYPE MILLIMETER WAVE ARRAY ANTENNA MODULE THEREOF

CROSS-REFERENCE TO RELATED PATENT APPLICATION

This application claims the benefit of priority to Taiwan Patent Application No. 110127632, filed on Jul. 28, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an array antenna module, and more particularly to a block-type millimeter wave array antenna module and a movable device configured for using the block-type millimeter wave array antenna module.

BACKGROUND OF THE DISCLOSURE

In the related art, a conventional antenna structure can be used to transmit or receive wireless signals. However, an antenna isolation provided by the conventional antenna structure is still far from ideal, and a ripple of a radiation pattern emanating from the conventional antenna structure cannot be decreased.

SUMMARY OF THE DISCLOSURE

In response to the above-referenced technical inadequacy, the present disclosure provides a movable device and a block-type millimeter wave array antenna module thereof.

In one aspect, the present disclosure provides a block-type millimeter wave array antenna module, which includes an antenna carrying substrate, an antenna signal transmitting group, an antenna signal receiving group, and a dummy antenna group. The antenna carrying substrate includes a carrier base and a plurality of block-shaped carrier bodies that are disposed on the carrier base and separate from each other. The block-shaped carrier bodies are divided into a plurality of first antenna carrier blocks adjacent to each other, a plurality of second antenna carrier blocks adjacent to each other, a plurality of third antenna carrier blocks adjacently disposed next to two sides of the first antenna carrier blocks, and a plurality of fourth antenna carrier blocks adjacently disposed next to two sides of the second antenna carrier blocks. The antenna signal transmitting group includes a plurality of signal transmitting antenna structures respectively disposed inside the first antenna carrier blocks. The antenna signal receiving group includes a plurality of signal receiving antenna structures respectively disposed inside the second antenna carrier blocks. The dummy antenna group includes a plurality of first dummy antenna structures respectively disposed inside the third antenna carrier blocks, and a plurality of second dummy antenna structures respectively disposed inside the fourth antenna carrier blocks. The signal transmitting antenna structures are arranged as an antenna signal transmitting array region, the signal receiving antenna structures are arranged as an antenna signal receiving array region, and the antenna signal transmitting array region and the antenna signal receiving array region are separated from each other by a predetermined horizontal distance so as to decrease mutual interference between the antenna signal transmitting array region and the antenna signal receiving array region. The first dummy antenna structures are arranged as a first left array dummy antenna region and a first right array dummy antenna region, and the antenna signal transmitting array region is arranged between the first left array dummy antenna region and the first right array dummy antenna region so as to decrease a ripple of an antenna radiation pattern emanating from each of the signal transmitting antenna structures, and increase a similarity of a plurality of antenna gains respectively of the signal transmitting antenna structures. The second dummy antenna structures are arranged as a second left array dummy antenna region and a second right array dummy antenna region, and the antenna signal receiving array region is arranged between the second left array dummy antenna region and the second right array dummy antenna region so as to decrease a ripple of an antenna radiation pattern emanating from each of the signal receiving antenna structures, and increase a similarity of a plurality of antenna gains respectively of the signal receiving antenna structures.

In another aspect, the present disclosure provides a block-type millimeter wave array antenna module, which includes an antenna carrying substrate, an antenna signal transmitting group, an antenna signal receiving group, and a dummy antenna group. The antenna carrying substrate includes a plurality of block-shaped carrier bodies separate from each other. The block-shaped carrier bodies are divided into a plurality of first antenna carrier blocks, a plurality of second antenna carrier blocks, a plurality of third antenna carrier blocks disposed next to two sides of the first antenna carrier blocks, and a plurality of fourth antenna carrier blocks disposed next to two sides of the second antenna carrier blocks. The antenna signal transmitting group includes a plurality of signal transmitting antenna structures that are respectively carried by the first antenna carrier blocks. The antenna signal receiving group includes a plurality of signal receiving antenna structures that are respectively carried by the second antenna carrier blocks. The dummy antenna group includes a plurality of first dummy antenna structures that are respectively carried by the third antenna carrier blocks, and a plurality of second dummy antenna structures that are respectively carried by the fourth antenna carrier blocks.

In yet another aspect, the present disclosure provides a movable device configured for using a block-type millimeter wave array antenna module. The block-type millimeter wave array antenna module includes an antenna carrying substrate, an antenna signal transmitting group, an antenna signal receiving group, and a dummy antenna group. The antenna carrying substrate includes a plurality of block-shaped carrier bodies separate from each other. The block-shaped carrier bodies are divided into a plurality of first antenna carrier blocks, a plurality of second antenna carrier blocks, a plurality of third antenna carrier blocks disposed next to two sides of the first antenna carrier blocks, and a plurality of fourth antenna carrier blocks disposed next to two sides of the second antenna carrier blocks. The antenna signal transmitting group includes a plurality of signal transmitting antenna structures that are respectively carried by the first antenna carrier blocks. The antenna signal receiving group includes a plurality of signal receiving antenna structures that are respectively carried by the second antenna carrier blocks. The dummy antenna group includes a plurality of first dummy antenna structures that are respectively carried by the third antenna carrier blocks, and a plurality of second dummy antenna structures that are respectively carried by the fourth antenna carrier blocks.

Therefore, in the movable device and the block-type millimeter wave array antenna module provided by the present disclosure, by virtue of "the antenna carrying substrate including a plurality of block-shaped carrier bodies separate from each other, and the block-shaped carrier bodies being divided into a plurality of first antenna carrier blocks, a plurality of second antenna carrier blocks, a plurality of third antenna carrier blocks disposed next to two sides of the first antenna carrier blocks, and a plurality of fourth antenna carrier blocks disposed next to two sides of the second antenna carrier blocks," "the antenna signal transmitting group including a plurality of signal transmitting antenna structures that are respectively carried by the first antenna carrier blocks," "the antenna signal receiving group including a plurality of signal receiving antenna structures that are respectively carried by the second antenna carrier blocks" and "the dummy antenna group including a plurality of first dummy antenna structures that are respectively carried by the third antenna carrier blocks, and a plurality of second dummy antenna structures that are respectively carried by the fourth antenna carrier blocks," the block-type millimeter wave array antenna module can be configured for transmitting wireless signals by cooperation of the signal transmitting antenna structures and the first dummy antenna structures, and the block-type millimeter wave array antenna module can be configured for receiving wireless signals by cooperation of the signal receiving antenna structures and the second dummy antenna structures.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
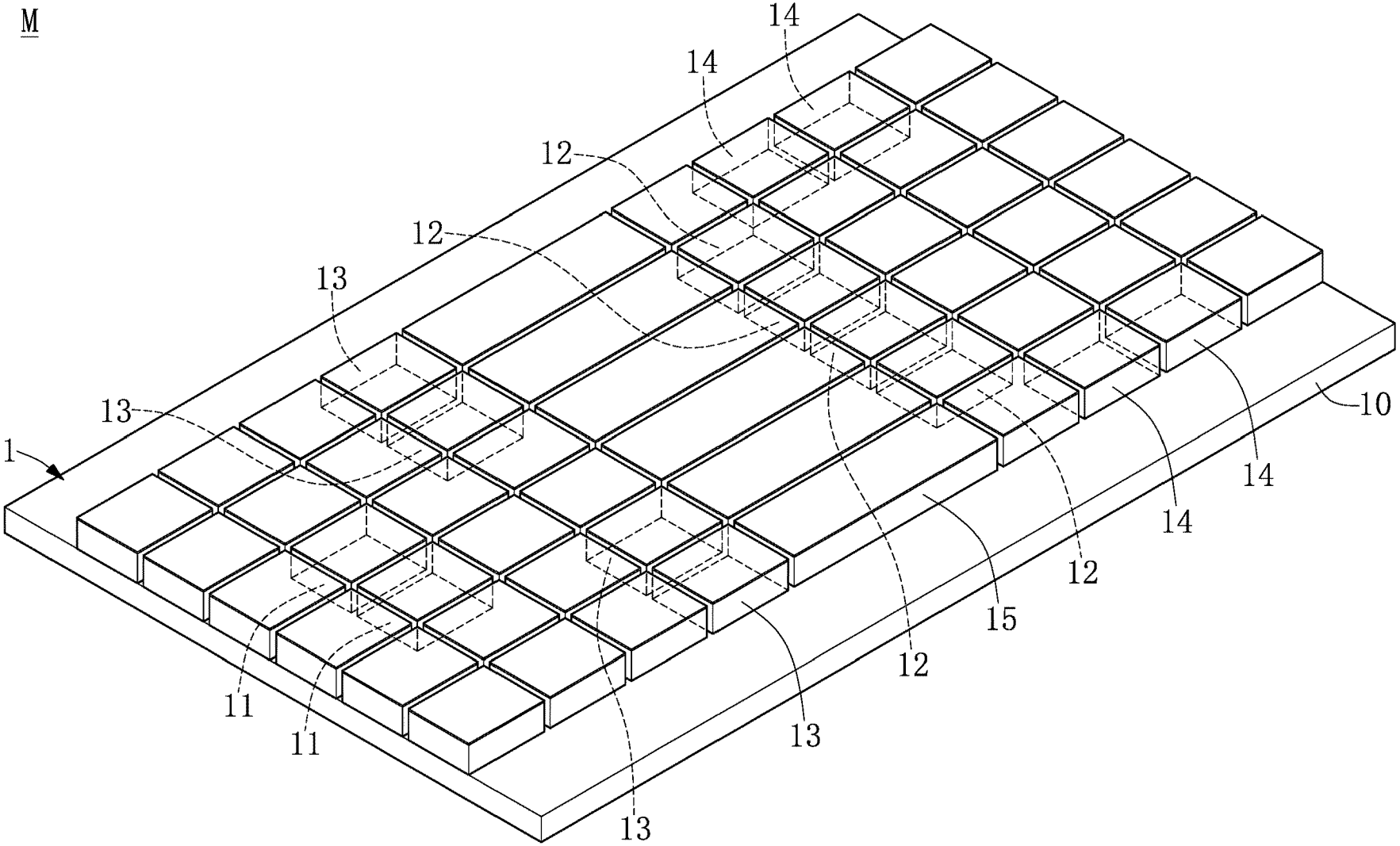
FIG. 1 is a schematic perspective view of a block-type millimeter wave array antenna module according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an," and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 10, the present disclosure provides a block-type millimeter wave array antenna module M, and a movable device D configured for using block-type millimeter wave array antenna module M. The block-type millimeter wave array antenna module M includes an antenna carrying substrate 1, an antenna signal transmitting group 2, an antenna signal receiving group 3, and a dummy antenna group 4. More particularly, the antenna carrying substrate 1 includes a plurality of block-shaped carrier bodies separate from each other, and the block-shaped carrier bodies can be divided into a plurality of first antenna carrier blocks 11, a plurality of second antenna carrier blocks 12, a plurality of third antenna carrier blocks 13 disposed next to two sides of the first antenna carrier blocks 11, and a plurality of fourth antenna carrier blocks 14 disposed next to two sides of the second antenna carrier blocks 12. The antenna signal transmitting group 2 includes a plurality of signal transmitting antenna structures 20 that are respectively carried by the first antenna carrier blocks 11. The antenna signal receiving group 3 includes a plurality of signal receiving antenna structures 30 that are respectively carried by the second antenna carrier blocks 12. The dummy antenna group 4 includes a plurality of first dummy antenna structures 41 that are respectively carried by the third antenna carrier blocks 13, and a plurality of second dummy antenna structures 42 that are respectively carried by the fourth antenna carrier blocks 14. Therefore, the block-type millimeter wave array antenna module M can be configured for transmitting wireless signals by cooperation of the signal transmitting antenna structures 20 and the first dummy antenna structures 41, and the block-type millimeter wave array antenna module M can be configured for receiving wireless signals by cooperation of the signal receiving antenna structures 30 and the second dummy antenna structures 42.

First Embodiment

Referring to FIG. 1 to FIG. 10, a first embodiment of the present disclosure provides a block-type millimeter wave array antenna module M, which includes an antenna carrying substrate 1, an antenna signal transmitting group 2, an antenna signal receiving group 3, and a dummy antenna group 4 (otherwise referred to as a "dummy load antenna group").

Firstly, as shown in FIG. 1, the antenna carrying substrate 1 includes a carrier base 10 and a plurality of block-shaped carrier bodies that are disposed on the carrier base 10 and separated from each other by a trench or a groove (not labeled), and the block-shaped carrier bodies can be divided into a plurality of first antenna carrier blocks 11, a plurality of second antenna carrier blocks 12, a plurality of third antenna carrier blocks 13, and a plurality of fourth antenna carrier blocks 14. More particularly, the first antenna carrier blocks 11 are adjacent to each other yet separated from each other by the trench, and the second antenna carrier blocks 12 are adjacent to each other yet separated from each other by the trench. In addition, the third antenna carrier blocks 13 are adjacent to each other yet separated from each other by the trench, and the third antenna carrier blocks 13 are divided into two first portions respectively and adjacently disposed next to two sides of the first antenna carrier blocks 11. The fourth antenna carrier blocks 14 are adjacent to each other yet separated from each other by the trench, and the fourth antenna carrier blocks 14 are divided into two second portions respectively and adjacently disposed next to two sides of the second antenna carrier blocks 12. For example, the antenna carrying substrate 1 can be a trench-shaped dielectric substrate (or any substrate capable of carrying antenna), and the trench-shaped dielectric substrate can be electrically connected to a signal receiving/transmitting circuit (such as a signal transceiver). However, the aforementioned description is merely an example, and is not meant to limit the scope of the present disclosure.

Moreover, referring to FIG. 1 to FIG. 5, the antenna signal transmitting group 2 includes a plurality of signal transmitting antenna structures 20 respectively disposed inside the first antenna carrier blocks 11, and the antenna signal receiving group 3 includes a plurality of signal receiving antenna structures 30 respectively disposed inside the second antenna carrier blocks 12. More particularly, referring to FIG. 3 and FIG. 4, the signal transmitting antenna structures 20 can be arranged as an antenna signal transmitting array region 201, and the first antenna carrier blocks 11 can be arranged within antenna signal transmitting array region 201. In addition, the signal receiving antenna structures 30 can be arranged as an antenna signal receiving array region 301, and the second antenna carrier blocks 12 can be arranged within the antenna signal receiving array region 301. Therefore, the antenna signal transmitting array region 201 and the antenna signal receiving array region 301 are separated from each other by a predetermined horizontal distance, so that block-type millimeter wave array antenna module M can be configured to decrease mutual interference (such as improving/decreasing an antenna isolation so as to obtain a lower antenna isolation) between the antenna signal transmitting array region 201 (for example, when the signal transmitting antenna structures 20 are configured for transmitting signals) and the antenna signal receiving array region 301 (for example, when the signal receiving antenna structures 30 are configured for receiving signals). For example, each of the signal transmitting antenna structures 20 can be a horn antenna, a dipole antenna, a patch antenna or any type of antenna structure, and the signal transmitting antenna structures 20 can be arranged as a horn array antenna, a dipole array antenna, a patch array antenna or any type of array antenna structure. In addition, each of the signal receiving antenna structures 30 can be a horn antenna, a dipole antenna, a patch antenna or any type of antenna structure, and the signal receiving antenna structures 30 can be arranged as a horn array antenna, a dipole array antenna, a patch array antenna or any type of array antenna structure. However, the aforementioned description is merely an example, and is not meant to limit the scope of the present disclosure.

Figure 2:
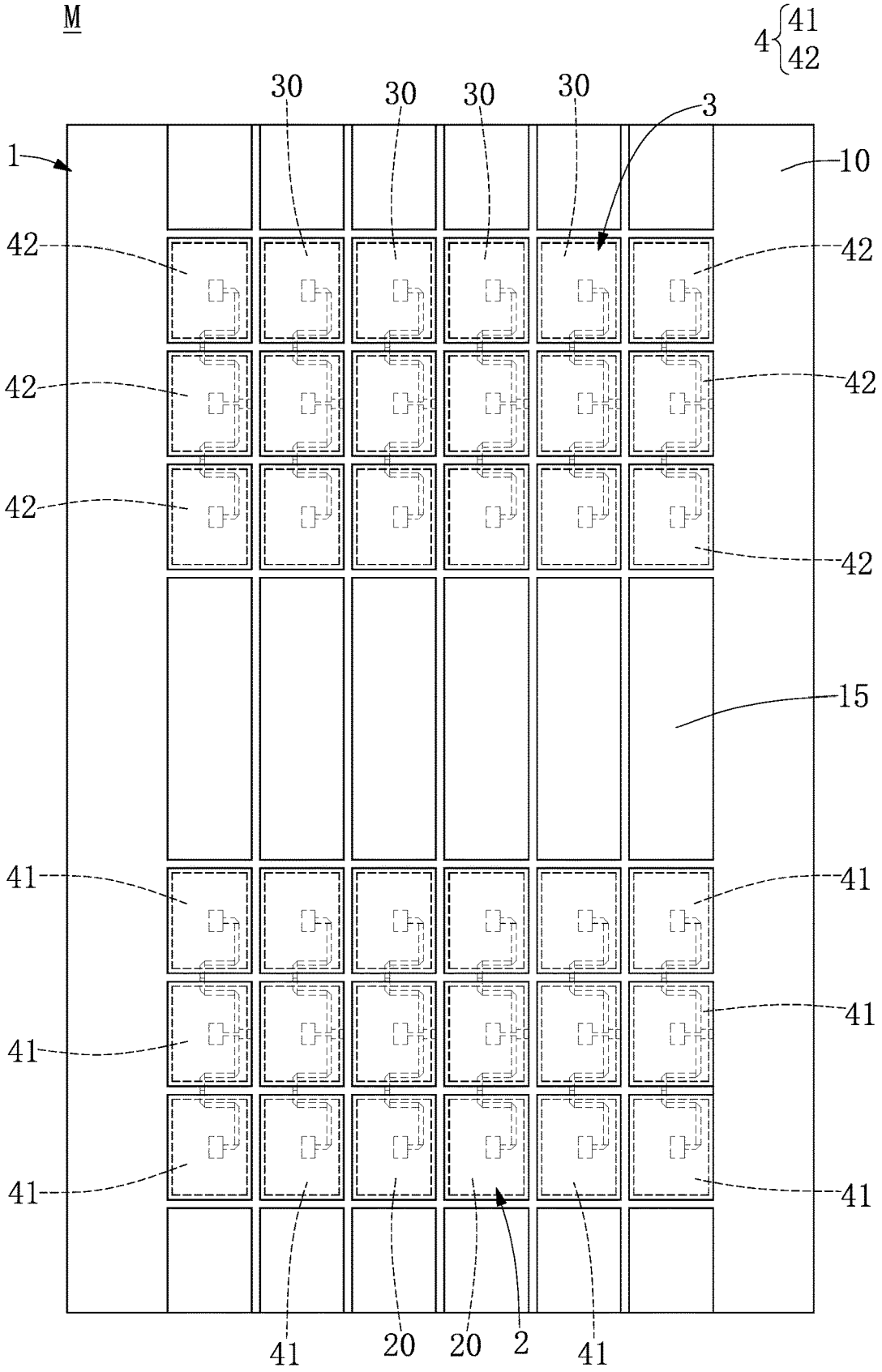
FIG. 2 is a schematic top view of the block-type millimeter wave array antenna module according to the first embodiment of the present disclosure.
Figure 3:
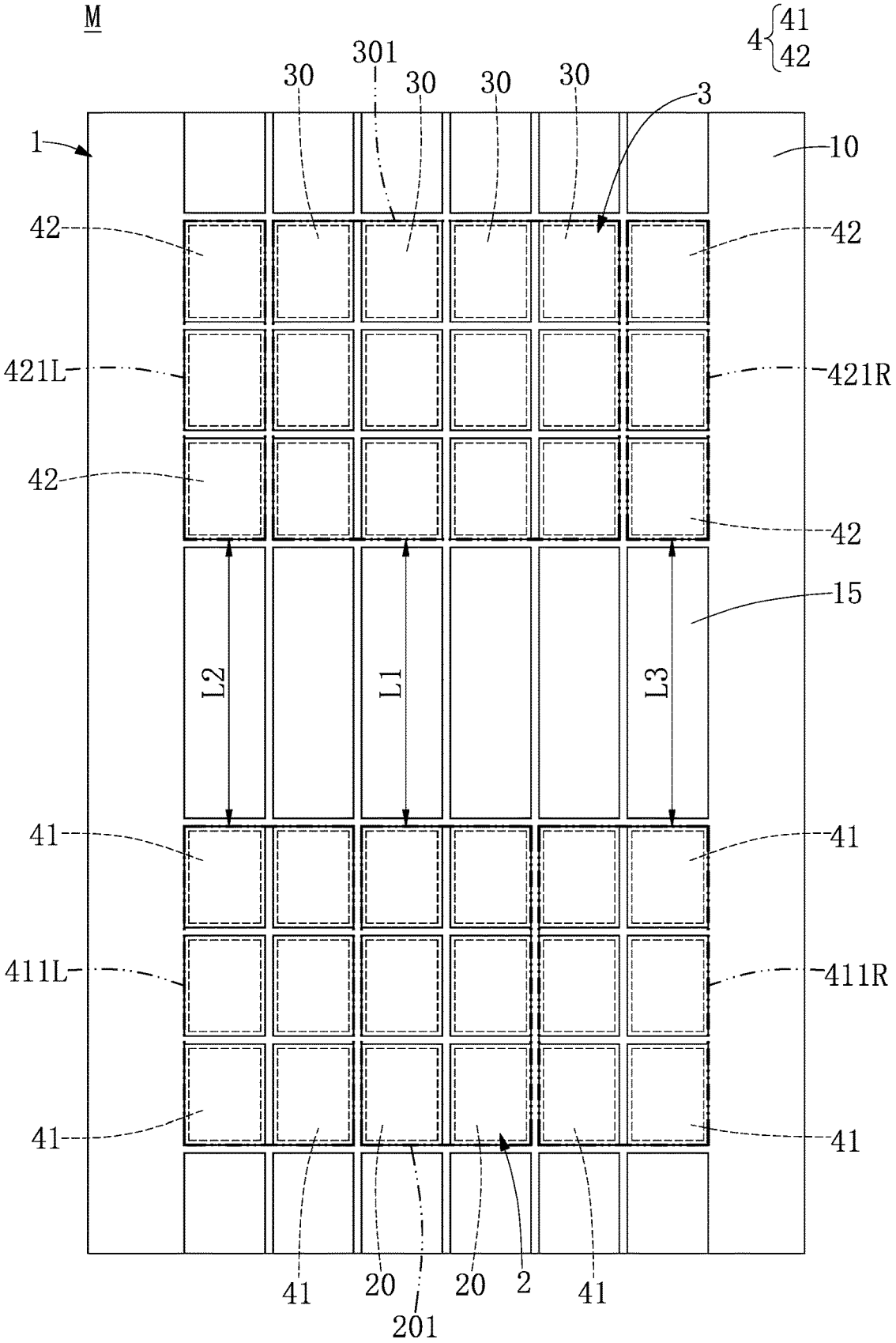
FIG. 3 is another schematic top view of the block-type millimeter wave array antenna module according to the first embodiment of the present disclosure.

Furthermore, referring to FIG. 1 to FIG. 3, FIG. 6 and FIG. 7, the dummy antenna group 4 includes a plurality of first dummy antenna structures 41 respectively disposed inside the third antenna carrier blocks 13. More particularly, referring to FIG. 3, FIG. 6 and FIG. 7, the first dummy antenna structures 41 can be arranged as a first left array dummy antenna region 411L and a first right array dummy antenna region 411R, and the two first portions of the third antenna carrier blocks 13 can be respectively disposed within the first left array dummy antenna region 411L and the first right array dummy antenna region 411R. It should be noted that, as shown in FIG. 3, the antenna signal transmitting array region 201 is arranged between the first left array dummy antenna region 411L and the first right array dummy antenna region 411R so as to decrease a ripple of an antenna radiation pattern provided by (such as emanating from) each of the signal transmitting antenna structures 20 (for example, a variation of the ripple of the antenna radiation pattern emanating from each of the signal transmitting antenna structures 20 can be less than ±1 dB), and increase a similarity of a plurality of antenna gains respectively of the signal transmitting antenna structures 20 (for example, the antenna gains respectively of the signal transmitting antenna structures 20 are similar to each other). It should be noted that the signal transmitting antenna structures 20 can also provide a forward antenna radiation pattern by the first dummy antenna structures 41. For example, each of the first dummy antenna structures 41 can be a grounding circuit structure electrically connected to 50Ω (ohm). In addition, each of the first dummy antenna structures 41 can be a horn antenna, a dipole antenna, a patch antenna or any type of antenna structure, and the first dummy antenna structures 41 can be arranged as a horn array antenna, a dipole array antenna, a patch array antenna or any type of array antenna structure. However, the aforementioned description is merely an example, and is not meant to limit the scope of the present disclosure.

In addition, referring to FIG. 1 to FIG. 3, FIG. 8 and FIG. 9, the dummy antenna group 4 includes a plurality of second dummy antenna structures 42 respectively disposed inside the fourth antenna carrier blocks 14. More particularly, referring to FIG. 3, FIG. 8 and FIG. 9, the second dummy antenna structures 42 can be arranged as a second left array dummy antenna region 421L and a second right array dummy antenna region 421R, and the two second portions of the fourth antenna carrier blocks 14 can be respectively disposed within the second left array dummy antenna region 421L and the second right array dummy antenna region 421R. It should be noted that, as shown in FIG. 3, the antenna signal receiving array region 301 is arranged between the second left array dummy antenna region 421L and the second right array dummy antenna region 421R so as to decrease a ripple of an antenna radiation pattern emanating from each of the signal receiving antenna structures 30 (for example, a variation of the ripple of the antenna radiation pattern emanating from each of the signal receiving antenna structures 30 can be less than ±1 dB), and increase a similarity of a plurality of antenna gains respectively of the signal receiving antenna structures 30 (for example, the antenna gains respectively of the signal receiving antenna structures 30 are similar to each other). It should be noted that the signal receiving antenna structures 30 can also provide a forward antenna radiation pattern by the second dummy antenna structures 42. For example, each of the second dummy antenna structures 42 can be a grounding circuit structure electrically connected to 50Ω (ohm). In addition, each of the second dummy antenna structures 42 can be a horn antenna, a dipole antenna, a patch antenna or any type of antenna structure, and the second dummy antenna structures 42 can be arranged as a horn array antenna, a dipole array antenna, a patch array antenna or any type of array antenna structure. However, the aforementioned description is merely an example, and is not meant to limit the scope of the present disclosure.

For example, referring to FIG. 1 to FIG. 3, the antenna carrying substrate 1 further includes a plurality of strip-shaped carrier bodies 15 disposed on the carrier base 10 and separate from each other, and the strip-shaped carrier bodies 15 are adjacent to each other and separated from each other by a trench or a groove (not labeled). More particularly, a first part of the strip-shaped carrier bodies 15 is disposed between the antenna signal transmitting array region 201 and the antenna signal receiving array region 301 so as to separate the antenna signal transmitting array region 201 and the antenna signal receiving array region 301 from each other by a first predetermined distance L1. A second part of the strip-shaped carrier bodies 15 is disposed between the first left array dummy antenna region 411L and the second left array dummy antenna region 421L so as to separate the first left array dummy antenna region 411L and the second left array dummy antenna region 421L from each other by a second predetermined distance L2. A third part of the strip-shaped carrier bodies 15 is disposed between the first right array dummy antenna region 411R and the second right array dummy antenna region 421R so as to separate the first right array dummy antenna region 411R and the second right array dummy antenna region 421R from each other by a third predetermined distance L3. However, the aforementioned description is merely an example, and is not meant to limit the scope of the present disclosure.

Figure 4:
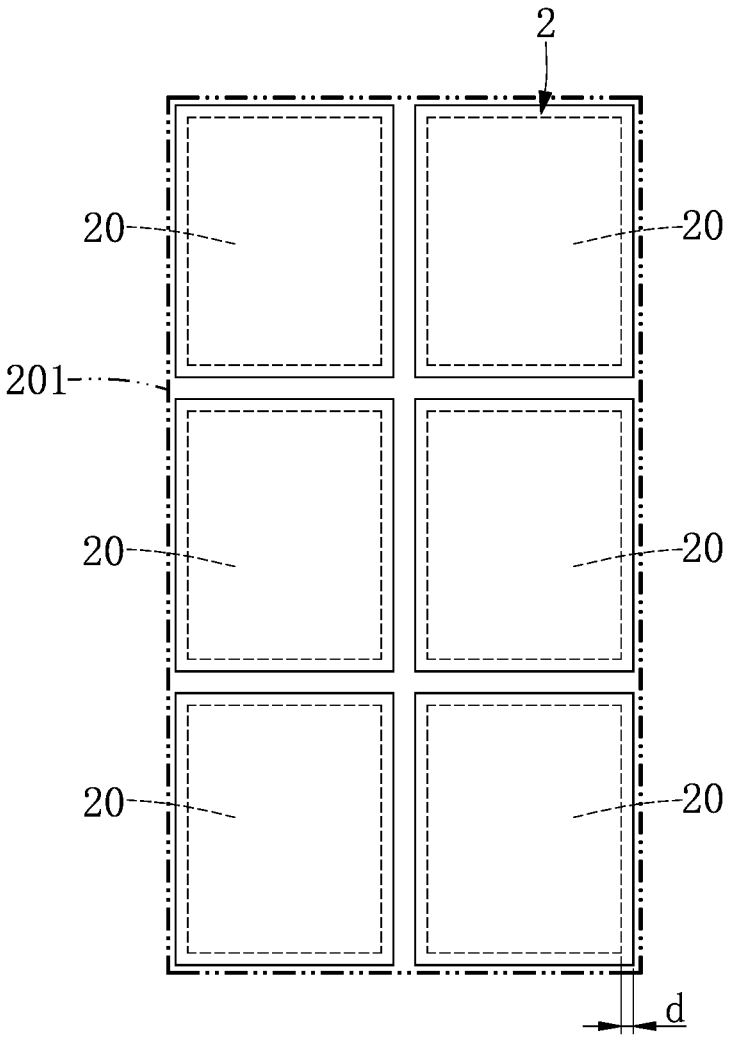
FIG. 4 is a schematic view of an antenna signal transmitting array region of the block-type millimeter wave array antenna module according to the first embodiment of the present disclosure.
Figure 5:
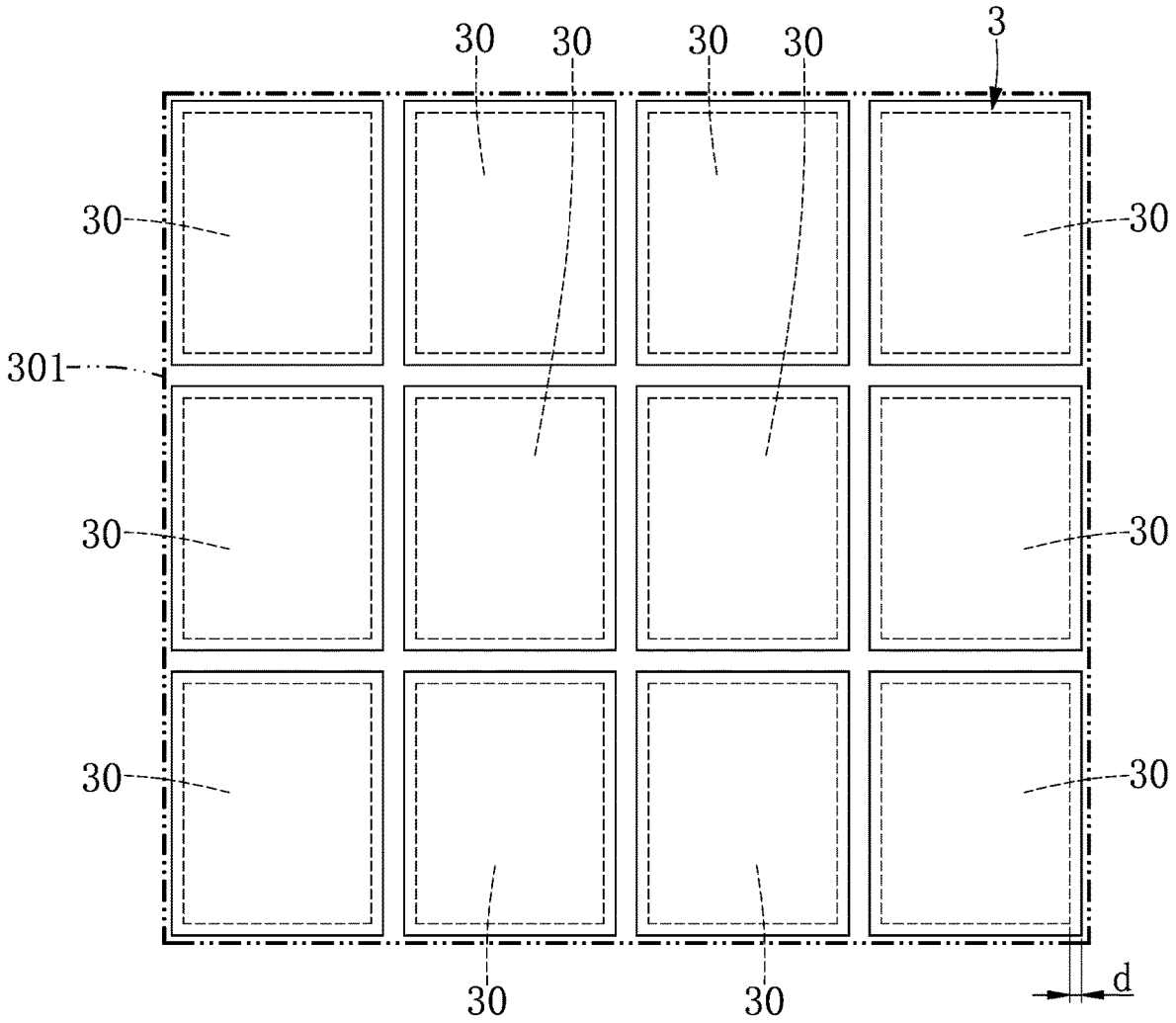
FIG. 5 is a schematic view of an antenna signal receiving array region of the block-type millimeter wave array antenna module according to the first embodiment of the present disclosure.
Figure 6:
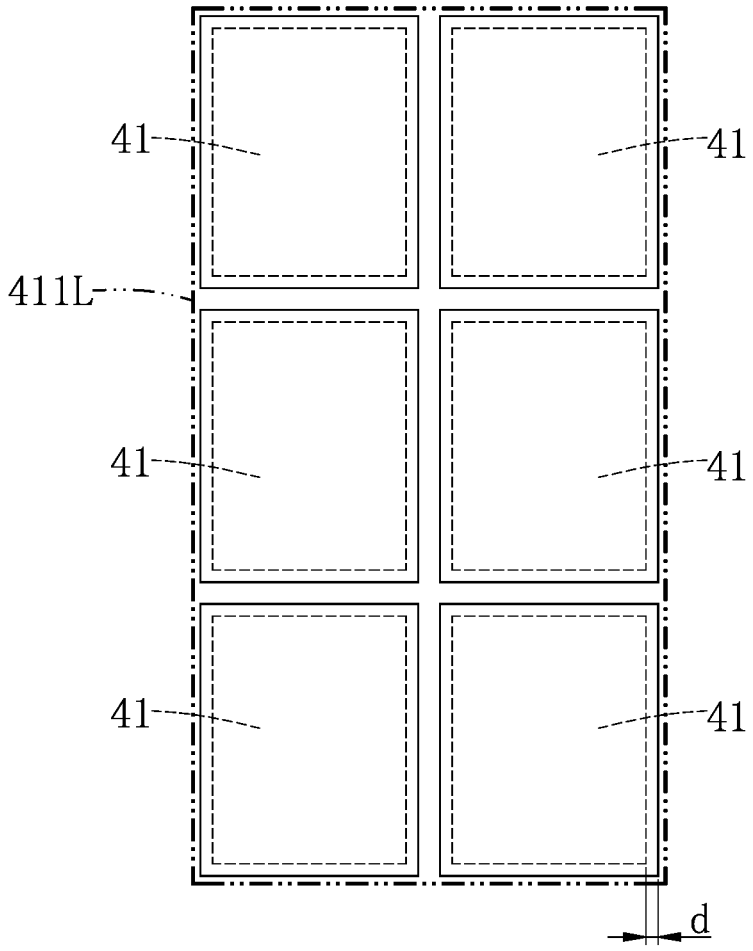
FIG. 6 is a schematic view of a first left array dummy antenna region of the block-type millimeter wave array antenna module according to the first embodiment of the present disclosure.
Figure 7:
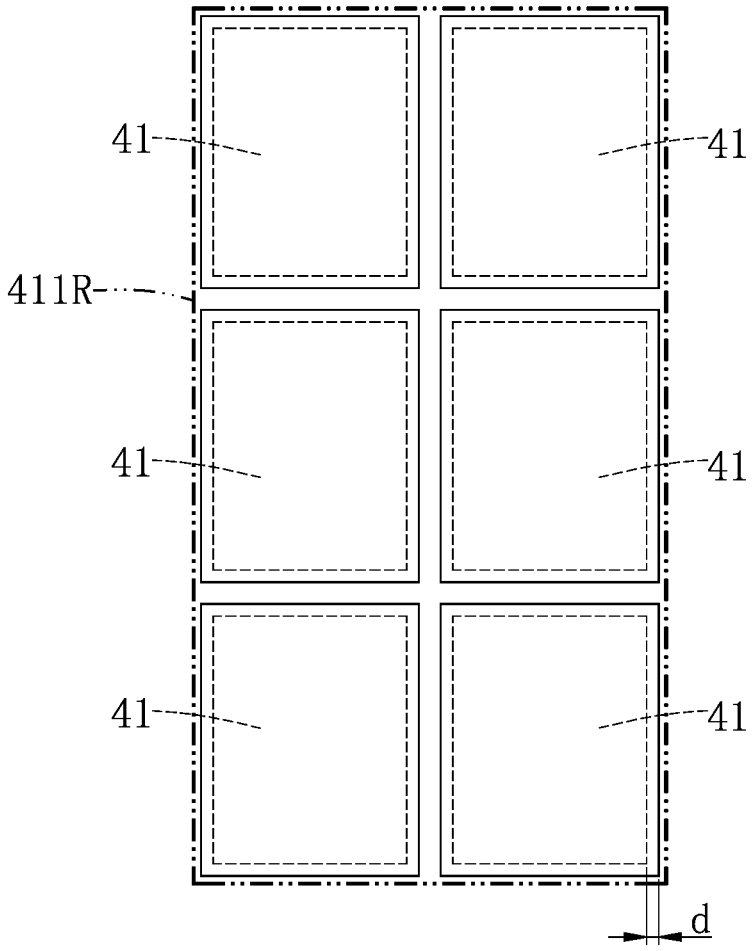
FIG. 7 is a schematic view of a first right array dummy antenna region of the block-type millimeter wave array antenna module according to the first embodiment of the present disclosure.
Figure 8:
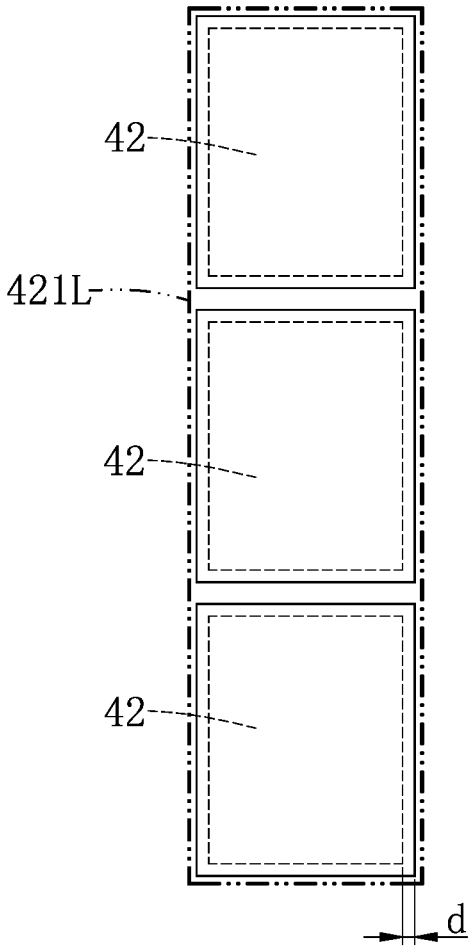
FIG. 8 is a schematic view of a second left array dummy antenna region of the block-type millimeter wave array antenna module according to the first embodiment of the present disclosure.
Figure 9:
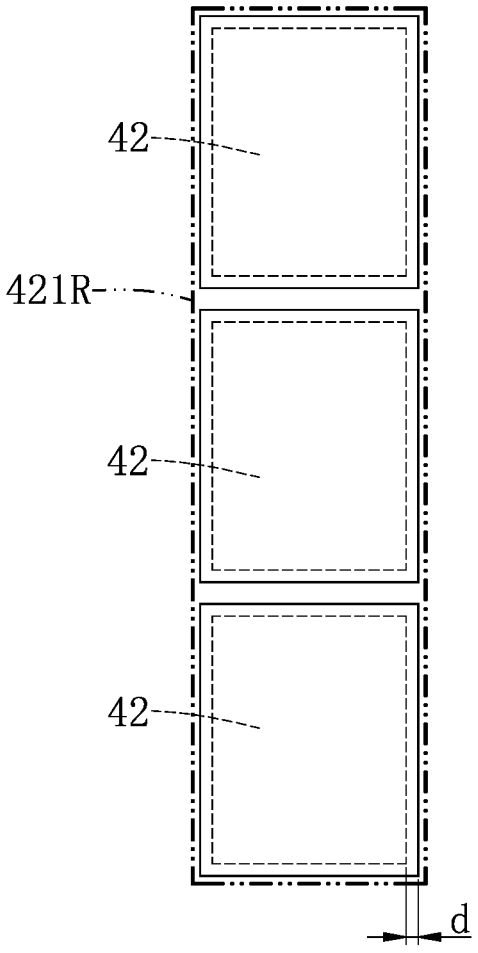
FIG. 9 is a schematic view of a second right array dummy antenna region of the block-type millimeter wave array antenna module according to the first embodiment of the present disclosure.

For example, referring to FIG. 3 to FIG. 9, when a wavelength of an operating frequency of the block-type millimeter wave array antenna module M for transmitting and receiving wireless signals is λ, a distance (i.e., the first predetermined distance L1) between the antenna signal transmitting array region 201 and the antenna signal receiving array region 301 can range from 2λ to 4λ (as shown in FIG. 3), a shortest distance d between the signal transmitting antenna structure 20 and an outer periphery of the first antenna carrier block 11 is less than λ/4 (i.e., a shortest distance from an opening edge of the signal transmitting antenna structure 20 to the trench, as shown in FIG. 4), a shortest distance d between the signal receiving antenna structure 30 and an outer periphery of the second antenna carrier block 12 is less than λ/4 (i.e., a shortest distance from an opening edge of the signal receiving antenna structure 30 to the trench, as shown in FIG. 5), a shortest distance d between the first dummy antenna structure 41 and an outer periphery of the third antenna carrier block 13 is less than λ/4 (i.e., a shortest distance from an opening edge of the first dummy antenna structure 41 to the trench, as shown in FIG. 6 or FIG. 7), and a shortest distance d between the second dummy antenna structure 42 and an outer periphery of the fourth antenna carrier block 14 is less than λ/4 (i.e., a shortest distance from an opening edge of the second dummy antenna structure 42 to the trench, as shown in FIG. 8 or FIG. 9). However, the aforementioned description is merely an example, and is not meant to limit the scope of the present disclosure.

Figure 10:
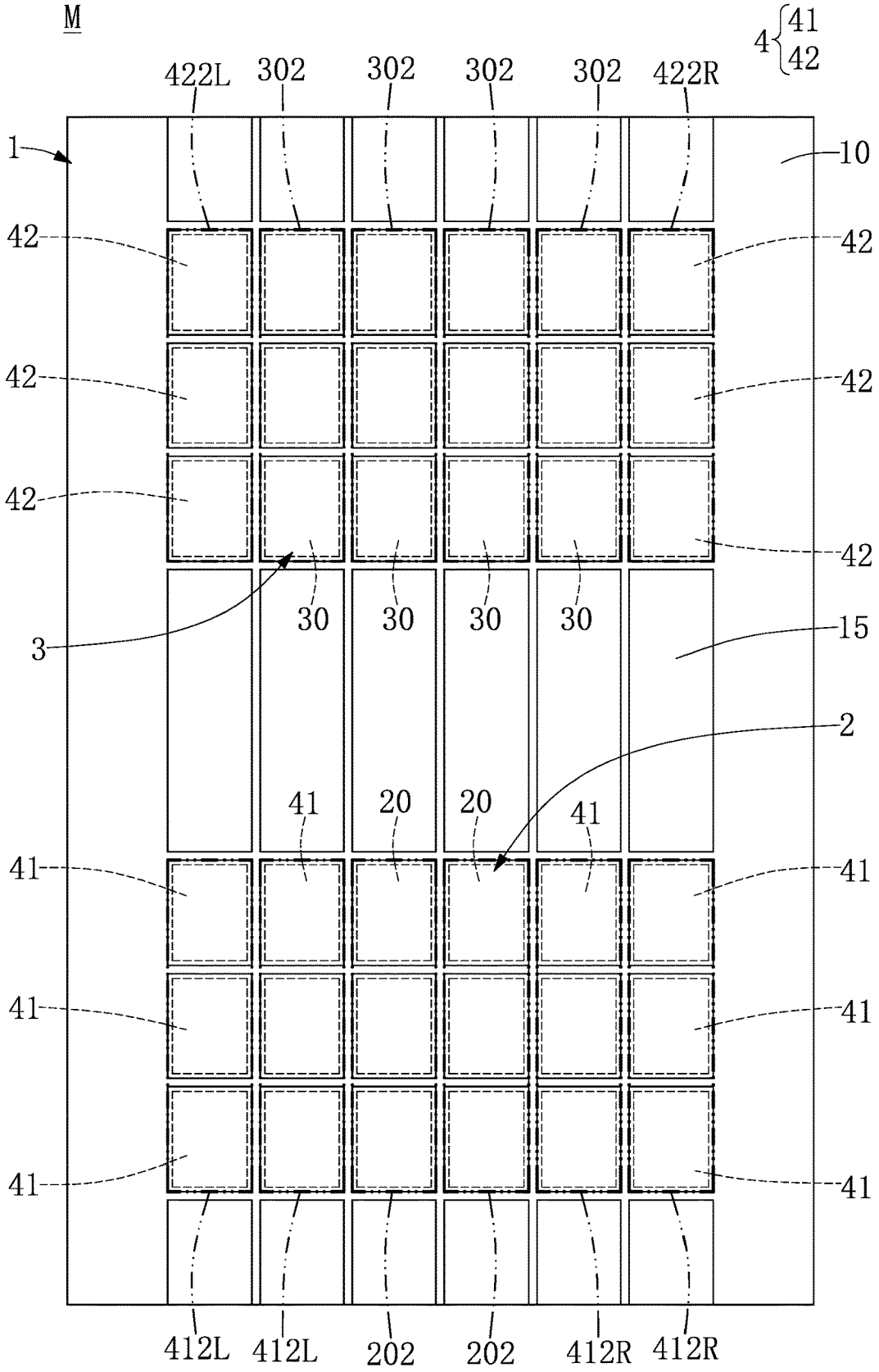
FIG. 10 is yet another schematic top view of the block-type millimeter wave array antenna module according to the first embodiment of the present disclosure.

For example, referring to FIG. 1, FIG. 2 and FIG. 10, the signal transmitting antenna structures 20 can be arranged as a plurality of antenna signal transmitting strip-shaped regions 202 that are mutually parallel (such as two antenna signal transmitting strip-shaped regions 202 each arranged in a 1×3 array), the signal receiving antenna structures 30 can be arranged as a plurality of antenna signal receiving strip-shaped regions 302 that are mutually parallel (such as four antenna signal receiving strip-shaped regions 302 each arranged in a 1×3 array), and a quantity of the antenna signal receiving strip-shaped regions 302 is about 1 to 3 times greater than a quantity of the antenna signal transmitting strip-shaped regions 202. Moreover, the first dummy antenna structures 41 can be arranged as a plurality of first left strip-shaped dummy antenna regions 412L (such as two first left strip-shaped dummy antenna regions 412L each arranged in a 1×3 array) and a plurality of first right strip-shaped dummy antenna regions 412R (such as two first right strip-shaped dummy antenna regions 412R each arranged in a 1×3 array), and the second dummy antenna structures 42 can be arranged as at least one second left strip-shaped dummy antenna region 422L (such as a second left strip-shaped dummy antenna region 422L arranged in a 1×3 array) and at least one second right strip-shaped dummy antenna region 422R (such as a second right strip-shaped dummy antenna region 422R arranged in a 1×3 array). In addition, a quantity of the first left strip-shaped dummy antenna regions 412L is about 1 to 3 times greater than a quantity of the second left strip-shaped dummy antenna region 422L, and a quantity of the first right strip-shaped dummy antenna regions 412R is about 1 to 3 times greater than a quantity of the second right strip-shaped dummy antenna region 422R. However, the aforementioned description is merely an example, and is not meant to limit the scope of the present disclosure.

It should be noted that, for example, referring to FIG. 2 and FIG. 10, the signal transmitting antenna structures 20 of each of the antenna signal transmitting strip-shaped regions 202 can be electrically connected with each other in parallel, and the signal receiving antenna structures 30 of each of the antenna signal receiving strip-shaped regions 302 can be electrically connected with each other in parallel (such as the dash-dotted line in FIG. 2). In addition, the first dummy antenna structures 41 of each of the first left strip-shaped dummy antenna regions 412L can be electrically connected with each other in parallel, and the first dummy antenna structures 41 of each of the first right strip-shaped dummy antenna regions 412R can be electrically connected with each other in parallel (such as the dash-dotted line in FIG. 2). Moreover, the second dummy antenna structures 42 of each of the second left strip-shaped dummy antenna regions 422L can be electrically connected with each other in parallel, and the second dummy antenna structures 42 of each of the second right strip-shaped dummy antenna regions 422R can be electrically connected with each other in parallel (such as the dash-dotted line in FIG. 2). However, the aforementioned description is merely an example, and is not meant to limit the scope of the present disclosure.

Therefore, the block-type millimeter wave array antenna module M can be configured for transmitting wireless signals by cooperation of the signal transmitting antenna structures 20 and the first dummy antenna structures 41, and the block-type millimeter wave array antenna module M can be configured for receiving wireless signals by cooperation of the signal receiving antenna structures 30 and the second dummy antenna structures 42. For example, the block-type millimeter wave array antenna module M can serve as a front vehicle distance detection module that is configured to cooperate with the signal transceiver for transmitting and receiving the wireless signals so as to detect a distance between two adjacent vehicles. However, the aforementioned description is merely an example, and is not meant to limit the scope of the present disclosure. However, the aforementioned description is merely an example, and is not meant to limit the scope of the present disclosure.

Second Embodiment

Figure 11:
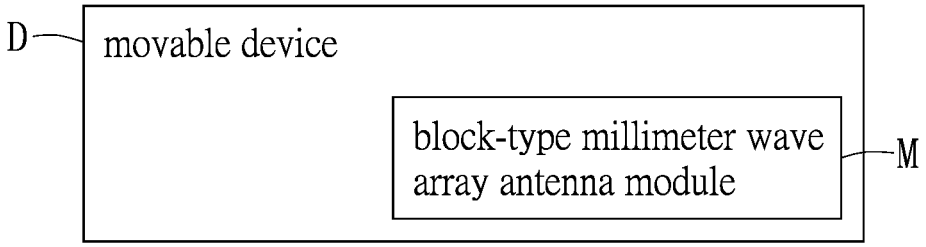
FIG. 11 is a functional block diagram of a movable device using the block-type millimeter wave array antenna module according to a second embodiment of the present disclosure.

Referring to FIG. 1, FIG. 2 and FIG. 11, a second embodiment of the present disclosure provides a movable device D configured for using a block-type millimeter wave array antenna module M, and the block-type millimeter wave array antenna module M includes an antenna carrying substrate 1, an antenna signal transmitting group 2, an antenna signal receiving group 3, and a dummy antenna group 4. For example, the movable device D can be a vehicle or a portable electronic product such as a desktop computer, a laptop computer or a tablet computer. However, the aforementioned description is merely an example, and is not meant to limit the scope of the present disclosure.

Beneficial Effects of the Embodiments

In conclusion, in the movable device and the block-type millimeter wave array antenna module M provided by the present disclosure, by virtue of "the antenna carrying substrate 1 including a plurality of block-shaped carrier bodies separate from each other, and the block-shaped carrier bodies being divided into a plurality of first antenna carrier blocks 11, a plurality of second antenna carrier blocks 12, a plurality of third antenna carrier blocks 13 disposed next to two sides of the first antenna carrier blocks 11, and a plurality of fourth antenna carrier blocks 14 disposed next to two sides of the second antenna carrier blocks 12," "the antenna signal transmitting group 2 including a plurality of signal transmitting antenna structures 20 that are respectively carried by the first antenna carrier blocks 11," "the antenna signal receiving group 3 including a plurality of signal receiving antenna structures 30 that are respectively carried by the second antenna carrier blocks 12" and "the dummy antenna group 4 including a plurality of first dummy antenna structures 41 that are respectively carried by the third antenna carrier blocks 13, and a plurality of second dummy antenna structures 42 that are respectively carried by the fourth antenna carrier blocks 14," the block-type millimeter wave array antenna module M can be configured for transmitting wireless signals by cooperation of the signal transmitting antenna structures 20 and the first dummy antenna structures 41, and the block-type millimeter wave array antenna module M can be configured for receiving wireless signals by cooperation of the signal receiving antenna structures 30 and the second dummy antenna structures 42.

For example, the antenna signal transmitting array region 201 and the antenna signal receiving array region 301 are separated from each other by a predetermined horizontal distance, so that block-type millimeter wave array antenna module M can be configured to decrease mutual interference between the antenna signal transmitting array region 201 and the antenna signal receiving array region 301 so as to obtain a lower antenna isolation.

For example, the antenna signal transmitting array region 201 is arranged between the first left array dummy antenna region 411L and the first right array dummy antenna region 411R, so that a ripple of an antenna radiation pattern emanating from each of the signal transmitting antenna structures 20 can be decreased, and a similarity of a plurality of antenna gains respectively of the signal transmitting antenna structures 20 can be increased.

For example, the antenna signal receiving array region 301 is arranged between the second left array dummy antenna region 421L and the second right array dummy antenna region 421R, so that a ripple of an antenna radiation pattern emanating from each of the signal receiving antenna structures 30 can be decreased, and a similarity of a plurality of antenna gains respectively of the signal receiving antenna structures 30 can be increased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A block-type millimeter wave array antenna module, comprising:

an antenna carrying substrate including a carrier base and a plurality of block-shaped carrier bodies that are disposed on the carrier base and separate from each other, wherein the block-shaped carrier bodies are divided into a plurality of first antenna carrier blocks adjacent to each other, a plurality of second antenna carrier blocks adjacent to each other, a plurality of third antenna carrier blocks adjacently disposed next to two sides of the first antenna carrier blocks, and a plurality of fourth antenna carrier blocks adjacently disposed next to two sides of the second antenna carrier blocks;

an antenna signal transmitting group including a plurality of signal transmitting antenna structures respectively disposed inside the first antenna carrier blocks;

an antenna signal receiving group including a plurality of signal receiving antenna structures respectively disposed inside the second antenna carrier blocks; and a dummy antenna group including a plurality of first dummy antenna structures respectively disposed inside the third antenna carrier blocks, and a plurality of second dummy antenna structures respectively disposed inside the fourth antenna carrier blocks;

wherein the signal transmitting antenna structures are arranged as an antenna signal transmitting array region, the signal receiving antenna structures are arranged as an antenna signal receiving array region, and the antenna signal transmitting array region and the antenna signal receiving array region are separated from each other by a predetermined horizontal distance so as to decrease mutual interference between the antenna signal transmitting array region and the antenna signal receiving array region;

wherein the first dummy antenna structures are arranged as a first left array dummy antenna region and a first right array dummy antenna region, and the antenna signal transmitting array region is arranged between the first left array dummy antenna region and the first right array dummy antenna region so as to decrease a ripple of an antenna radiation pattern emanating from each of the signal transmitting antenna structures, and increase a similarity of a plurality of antenna gains respectively of the signal transmitting antenna structures;

wherein the second dummy antenna structures are arranged as a second left array dummy antenna region and a second right array dummy antenna region, and the antenna signal receiving array region is arranged between the second left array dummy antenna region and the second right array dummy antenna region so as to decrease a ripple of an antenna radiation pattern emanating from each of the signal receiving antenna structures, and increase a similarity of a plurality of antenna gains respectively of the signal receiving antenna structures.

2. The block-type millimeter wave array antenna module according to claim 1, wherein the antenna carrying substrate includes a plurality of strip-shaped carrier bodies being disposed on the carrier base and being separate from each other;

wherein a first part of the strip-shaped carrier bodies is disposed between the antenna signal transmitting array region and the antenna signal receiving array region so as to separate the antenna signal transmitting array region and the antenna signal receiving array region from each other by a first predetermined distance;

wherein a second part of the strip-shaped carrier bodies is disposed between the first left array dummy antenna region and the second left array dummy antenna region so as to separate the first left array dummy antenna region and the second left array dummy antenna region from each other by a second predetermined distance;

wherein a third part of the strip-shaped carrier bodies is disposed between the first right array dummy antenna region and the second right array dummy antenna region so as to separate the first right array dummy antenna region and the second right array dummy antenna region from each other by a third predetermined distance;

wherein, when a wavelength of an operating frequency of the block-type millimeter wave array antenna module for transmitting and receiving wireless signals is $\lambda$, a distance between the antenna signal transmitting array region and the antenna signal receiving array region ranges from $2\lambda$ to $4\lambda$, a shortest distance between the signal transmitting antenna structure and an outer periphery of the first antenna carrier block is less than $\lambda/4$, a shortest distance between the signal receiving antenna structure and an outer periphery of the second antenna carrier block is less than $\lambda/4$, a shortest distance between the first dummy antenna structure and an outer periphery of the third antenna carrier block is less than $\lambda/4$, and a shortest distance between the second dummy antenna structure and an outer periphery of the fourth antenna carrier block is less than $\lambda/4$.

3. The block-type millimeter wave array antenna module according to claim 1, wherein the signal transmitting antenna structures are arranged as a plurality of antenna signal transmitting strip-shaped regions that are mutually parallel, the signal receiving antenna structures are arranged as a plurality of antenna signal receiving strip-shaped regions that are mutually parallel, and a quantity of the antenna signal receiving strip-shaped regions is about 1 to 3 times greater than a quantity of the antenna signal transmitting strip-shaped regions;

wherein the first dummy antenna structures are arranged as a plurality of first left strip-shaped dummy antenna regions and a plurality of first right strip-shaped dummy antenna regions, the second dummy antenna structures are arranged as a plurality of second left strip-shaped dummy antenna regions and a plurality of second right strip-shaped dummy antenna regions, a quantity of the first left strip-shaped dummy antenna regions is about 1 to 3 times greater than a quantity of the second left strip-shaped dummy antenna regions, and a quantity of the first right strip-shaped dummy antenna regions is about 1 to 3 times greater than a quantity of the second right strip-shaped dummy antenna regions;

wherein the signal transmitting antenna structures of each of the antenna signal transmitting strip-shaped regions are electrically connected with each other in parallel, and the signal receiving antenna structures of each of the antenna signal receiving strip-shaped regions are electrically connected with each other in parallel;

wherein the first dummy antenna structures of each of the first left strip-shaped dummy antenna regions are electrically connected with each other in parallel, and the first dummy antenna structures of each of the first right strip-shaped dummy antenna regions are electrically connected with each other in parallel;

wherein the second dummy antenna structures of each of the second left strip-shaped dummy antenna regions are electrically connected with each other in parallel, and the second dummy antenna structures of each of the second right strip-shaped dummy antenna regions are electrically connected with each other in parallel.

4. A block-type millimeter wave array antenna module, comprising:

an antenna carrying substrate including a plurality of block-shaped carrier bodies separate from each other, wherein the block-shaped carrier bodies are divided into a plurality of first antenna carrier blocks, a plurality of second antenna carrier blocks, a plurality of third antenna carrier blocks disposed next to two sides of the first antenna carrier blocks, and a plurality of fourth antenna carrier blocks disposed next to two sides of the second antenna carrier blocks;

an antenna signal transmitting group including a plurality of signal transmitting antenna structures that are respectively carried by the first antenna carrier blocks;

an antenna signal receiving group including a plurality of signal receiving antenna structures that are respectively carried by the second antenna carrier blocks; and a dummy antenna group including a plurality of first dummy antenna structures that are respectively carried by the third antenna carrier blocks, and a plurality of second dummy antenna structures that are respectively carried by the fourth antenna carrier blocks.

5. The block-type millimeter wave array antenna module according to claim 4, wherein the signal transmitting antenna structures are arranged as an antenna signal transmitting array region;

wherein the first dummy antenna structures are arranged as a first left array dummy antenna region and a first right array dummy antenna region, and the antenna signal transmitting array region is arranged between the first left array dummy antenna region and the first right array dummy antenna region so as to decrease a ripple of an antenna radiation pattern emanating from each of the signal transmitting antenna structures, and increase a similarity of a plurality of antenna gains respectively of the signal transmitting antenna structures.

6. The block-type millimeter wave array antenna module according to claim 4, wherein the signal receiving antenna structures are arranged as an antenna signal receiving array region;

wherein the second dummy antenna structures are arranged as a second left array dummy antenna region and a second right array dummy antenna region, and the antenna signal receiving array region is arranged between the second left array dummy antenna region and the second right array dummy antenna region so as to decrease a ripple of an antenna radiation pattern emanating from each of the signal receiving antenna structures, and increase a similarity of a plurality of antenna gains respectively of the signal receiving antenna structures.

7. The block-type millimeter wave array antenna module according to claim 4, wherein the signal transmitting antenna structures are arranged as an antenna signal transmitting array region, the signal receiving antenna structures are arranged as an antenna signal receiving array region, and the antenna signal transmitting array region and the antenna signal receiving array region are separated from each other by a predetermined horizontal distance so as to decrease mutual interference between the antenna signal transmitting array region and the antenna signal receiving array region;

wherein, when a wavelength of an operating frequency of the block-type millimeter wave array antenna module for transmitting and receiving wireless signals is $\lambda$, a distance between the antenna signal transmitting array region and the antenna signal receiving array region ranges from $2\lambda$ to $4\lambda$, a shortest distance between the signal transmitting antenna structure and an outer periphery of the first antenna carrier block is less than $\lambda/4$, a shortest distance between the signal receiving antenna structure and an outer periphery of the second antenna carrier block is less than $\lambda/4$, a shortest distance between the first dummy antenna structure and an outer periphery of the third antenna carrier block is less than $\lambda/4$, and a shortest distance between the second dummy antenna structure and an outer periphery of the fourth antenna carrier block is less than $\lambda/4$.

8. The block-type millimeter wave array antenna module according to claim 4, wherein the signal transmitting antenna structures are arranged as a plurality of antenna signal transmitting strip-shaped regions that are mutually parallel, the signal receiving antenna structures are arranged as a plurality of antenna signal receiving strip-shaped regions that are mutually parallel, and a quantity of the antenna signal receiving strip-shaped regions is about 1 to 3 times greater than a quantity of the antenna signal transmitting strip-shaped regions;

wherein the first dummy antenna structures are arranged as a plurality of first left strip-shaped dummy antenna regions and a plurality of first right strip-shaped dummy antenna regions, the second dummy antenna structures are arranged as a plurality of second left strip-shaped dummy antenna regions and a plurality of second right strip-shaped dummy antenna regions, a quantity of the first left strip-shaped dummy antenna regions is about 1 to 3 times greater than a quantity of the second left strip-shaped dummy antenna regions, and a quantity of the first right strip-shaped dummy antenna regions is about 1 to 3 times greater than a quantity of the second right strip-shaped dummy antenna regions;

wherein the signal transmitting antenna structures of each of the antenna signal transmitting strip-shaped regions are electrically connected with each other in parallel, and the signal receiving antenna structures of each of the antenna signal receiving strip-shaped regions are electrically connected with each other in parallel;

wherein the first dummy antenna structures of each of the first left strip-shaped dummy antenna regions are electrically connected with each other in parallel, and the first dummy antenna structures of each of the first right strip-shaped dummy antenna regions are electrically connected with each other in parallel;

wherein the second dummy antenna structures of each of the second left strip-shaped dummy antenna regions are electrically connected with each other in parallel, and the second dummy antenna structures of each of the second right strip-shaped dummy antenna regions are electrically connected with each other in parallel.

9. A movable device configured for using a block-type millimeter wave array antenna module, the block-type millimeter wave array antenna module comprising:

an antenna carrying substrate including a plurality of block-shaped carrier bodies separate from each other, wherein the block-shaped carrier bodies are divided into a plurality of first antenna carrier blocks, a plurality of second antenna carrier blocks, a plurality of third antenna carrier blocks disposed next to two sides of the first antenna carrier blocks, and a plurality of fourth antenna carrier blocks disposed next to two sides of the second antenna carrier blocks;

an antenna signal transmitting group including a plurality of signal transmitting antenna structures that are respectively carried by the first antenna carrier blocks;

an antenna signal receiving group including a plurality of signal receiving antenna structures that are respectively carried by the second antenna carrier blocks; and a dummy antenna group including a plurality of first dummy antenna structures that are respectively carried by the third antenna carrier blocks, and a plurality of second dummy antenna structures that are respectively carried by the fourth antenna carrier blocks.

10. The movable device according to claim 9, wherein the signal transmitting antenna structures are arranged as an antenna signal transmitting array region, the signal receiving antenna structures are arranged as an antenna signal receiving array region, and the antenna signal transmitting array region and the antenna signal receiving array region are separated from each other by a predetermined horizontal distance so as to decrease mutual interference between the antenna signal transmitting array region and the antenna signal receiving array region;

wherein, when a wavelength of an operating frequency of the block-type millimeter wave array antenna module for transmitting and receiving wireless signals is $\lambda$, a distance between the antenna signal transmitting array region and the antenna signal receiving array region ranges from $2\lambda$ to $4\lambda$, a shortest distance between the signal transmitting antenna structure and an outer periphery of the first antenna carrier block is less than $\lambda/4$, a shortest distance between the signal receiving antenna structure and an outer periphery of the second antenna carrier block is less than $\lambda/4$, a shortest distance between the first dummy antenna structure and an outer periphery of the third antenna carrier block is less than $\lambda/4$, and a shortest distance between the second dummy antenna structure and an outer periphery of the fourth antenna carrier block is less than $\lambda/4$.

* * * * *